US011241772B1

(12) United States Patent
Roche

(10) Patent No.: US 11,241,772 B1
(45) Date of Patent: Feb. 8, 2022

(54) VEHICLE O2 SENSOR WRENCH ATTACHMENT

(71) Applicant: Ryan P. Roche, Highlands Dr., CO (US)

(72) Inventor: Ryan P. Roche, Highlands Dr., CO (US)

( * ) Notice: Subject to any disclaimer, the term of this patent is extended or adjusted under 35 U.S.C. 154(b) by 16 days.

(21) Appl. No.: 16/866,147

(22) Filed: May 4, 2020

Related U.S. Application Data

(63) Continuation-in-part of application No. 16/460,789, filed on Jul. 2, 2019, now Pat. No. 10,661,415.

(51) Int. Cl.
*B25B 13/08* (2006.01)
*B25B 23/00* (2006.01)
*B25B 13/48* (2006.01)

(52) U.S. Cl.
CPC ..... *B25B 13/08* (2013.01); *B25B 13/48* (2013.01); *B25B 23/0028* (2013.01)

(58) Field of Classification Search
CPC ..... B25B 21/02; B25B 19/00; B25B 23/00; B25B 23/0007; B25B 23/0042; B25B 23/0028; B25B 13/08; B25B 13/48; B25G 1/06; B25G 1/005; B25G 1/043
USPC ..... 173/93, 93.5; 81/463, 465, 466, 177.2, 81/177.1, 177.8
See application file for complete search history.

(56) References Cited

U.S. PATENT DOCUMENTS 6,354,178 B2 * 3/2002 Pool ..... B25B 21/002 81/463
6,769,334 B1 * 8/2004 Whitehead ..... B25B 19/00 81/177.85
2005/0132850 A1 * 6/2005 Hamann ..... B25B 19/00 81/465

OTHER PUBLICATIONS

Notice of Allowance, U.S. Appl. No. 16/460,789.

* cited by examiner

*Primary Examiner* — Chelsea E Stinson
*Assistant Examiner* — Mary C Hibbert-Copeland
(74) *Attorney, Agent, or Firm* — Shaver & Swanson, LLP; Scott D. Swanson

(57) ABSTRACT

A vehicle $O_2$ sensor wrench attachment is made integral with a safety latch for an air hammer rod. The safety latch comprises a jaw assembly that has a swivel tooth that is manually moved from an open position to allow insertion of the air hammer rod into the mouth. For a working mode using the air hammer to hit the jaw assembly, the tooth is moved to a locked mode. A ball and spring assembly ensures the air hammer rod, having a transverse rod, stays in the locked mode during operation.

10 Claims, 5 Drawing Sheets

VEHICLE O2 SENSOR WRENCH ATTACHMENT

CROSS-REFERENCE PATENTS

The present Continuation In Part Application claims priority to abandoned non-provisional application Ser. No. 16/369,091 filed Mar. 29, 2019, and U.S. App. Ser. No. 16/460,789 filed Jul. 2, 2019 and issued as U.S. Pat. No. 10,661,415 issued on May 26, 2020 which are incorporated herein by reference in their entirety.

FIELD OF INVENTION

The present invention relates to using a prior art air hammer to safely drive a free end of a vehicle exhaust system $O_2$ sensor wrench.

BACKGROUND OF THE INVENTION

Air hammers have been used to drive a wrench to loosen a stuck nut. U.S. Pat. No. 1,923,122 discloses an open end wrench with a free end having a custom receiver for an air hammer. The custom receiver is a swivel mounted ball that has an extension rod. The extension rod has a reduced stud 12 upon which an air hammer is connected. The swivel mount allows angular adjustment of the air hammer in relation to the wrench. The custom receiver cannot be removed from the wrench, thus use of the wrench without the air hammer is restricted.

U.S. Pat. No. 7,089,833 discloses a conventional socket 9 fit over a stuck nut. Next a handlebar 5, called a stabilizing fixture, is connected to the socket 9. At the socket 9 connection extends a lever arm 10. The free end of the lever arm 10 receives a transfer fixture 13 that connects to a standard pneumatic hammer shank 12 which in turn is attached to the pneumatic hammer 15. The user holds the handlebar 5 while activating the pneumatic hammer to hit the free end of the lever arm 10. No locking of the transfer fixture 13 to a cylinder rod 14 on the lever arm is disclosed. Thus, an accidental separation of the hammer from the lever arm is possible. This can be dangerous. Also the entire assembly cannot be used in tight places such as for a wheel hub removal.

U.S. Pat. No. 4,722,252 discloses an air powered ratchet head wrench with an air drive motor mounted inside the handle of the wrench. Very little leverage torque is provided. High speed loosening of a nut is provided.

Exhaust system $O_2$ sensor are historically difficult to replace because they exist in the rust and dirt environment of an exhaust pipe.

What is needed in the art is an $O_2$ sensor wrench that safely and removably receives an air hammer work end. A lock is needed to prevent a separation of the air hammer from the wrench during use. The present invention provides these features.

SUMMARY OF THE INVENTION

The main aspect of the present invention is to provide a safety latch on a special $O_2$ sensor wrench for attachment of an air hammer.

Another aspect of the present invention is to allow the wrench to be used conveniently in a conventional manual manner.

Another aspect of the present invention is to provide a reliable locked engagement of an air hammer to the free end of the wrench.

Other aspects of this invention will appear from the following description and appended claims, reference being made to the accompanying drawings forming a part of this specification wherein like reference characters designate corresponding parts in the several views.

In operation a custom made wrench is designed to clasp an exhaust system $O_2$ sensor and has a free end with a semi-circular jaw. The jaw has a simple two position locking tooth. The tooth has a spring assembly to maintain an open mode to insert an air hammer transfer fixture and a closed mode to lock the transfer fixture to the wrench. Thus, a safe operation of the air hammer is provided to loosen a stuck $O_2$ sensor under a vehicle.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
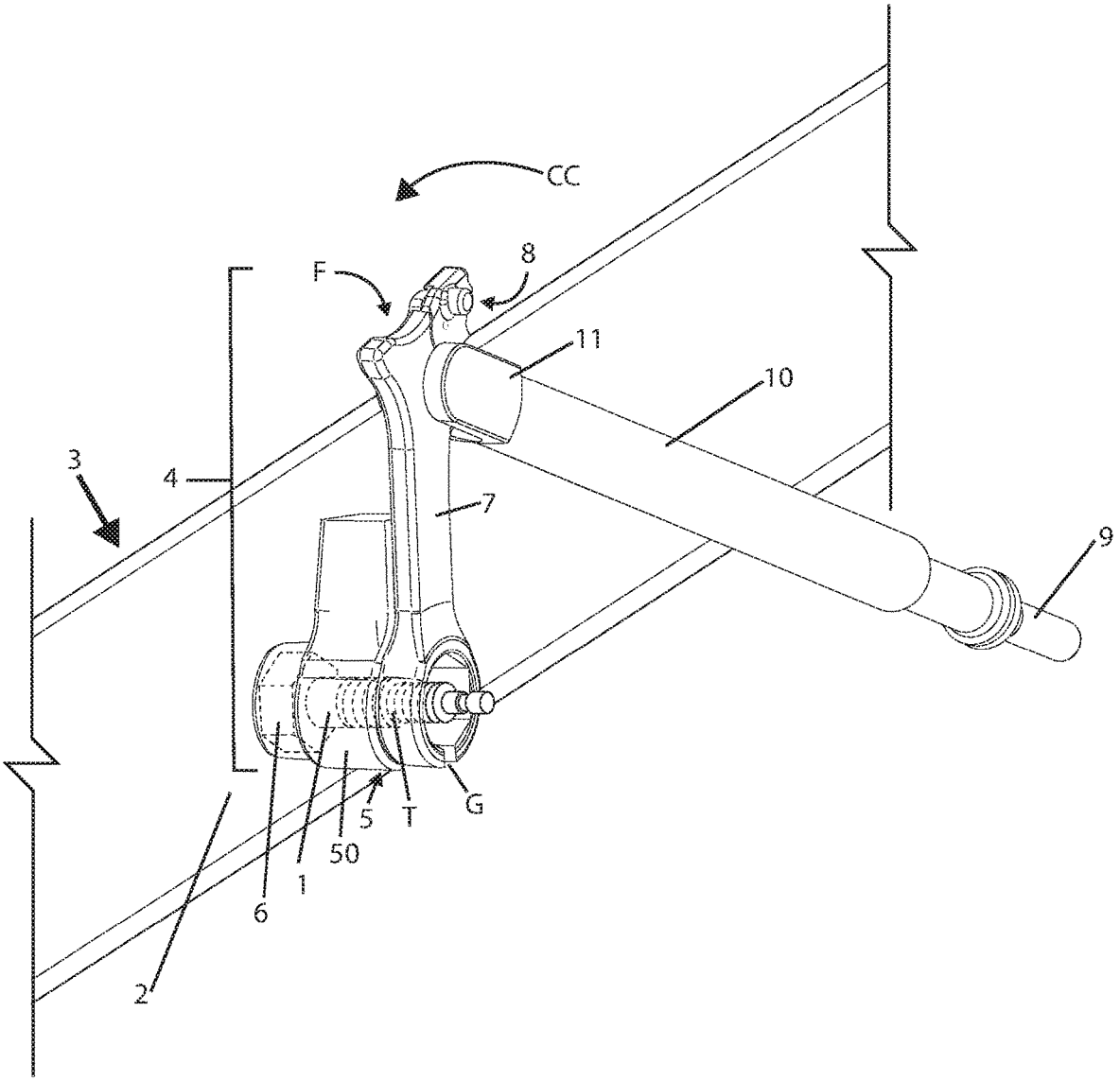
FIG. 1 is a front perspective view of the wrench in use on an $O_2$ sensor on an exhaust system.

Referring first to FIG. 1 an $O_2$ sensor 1 is being removed from the exhaust pipe 2 of the vehicle 3. The wrench 4 has a working end 5 which in this embodiment is an open ended $O_2$ sensor socket 50. Other types of working ends will work, as is known by a person of ordinary skill in the art. The nut 6 has been mounted by the working end 5 of the wrench 4. The shank 7 connects the working end 5 to the jaw assembly 8 located at the free end of the wrench 4. The gap G in socket 50 fits over the thin top T of $O_2$ sensor 1.

An air hammer (not shown) attaches to proximal end 9 of the drive shaft 10. The distal end of drive shaft 10 has a fork type bracket 11, see FIG. 2. The crossbar 12 spans across the ends of fork type bracket 11. As the air hammer vibrates, the forces are transmitted from the crossbar 12 to the jaw 13. This vibrating force loosens the nut 6 to turn counter clockwise CC in the tight workspace shown. Thus, the mechanic gains great force leverage on nut 6 without risking slamming his hand into the vehicle 3.

Figure 2:
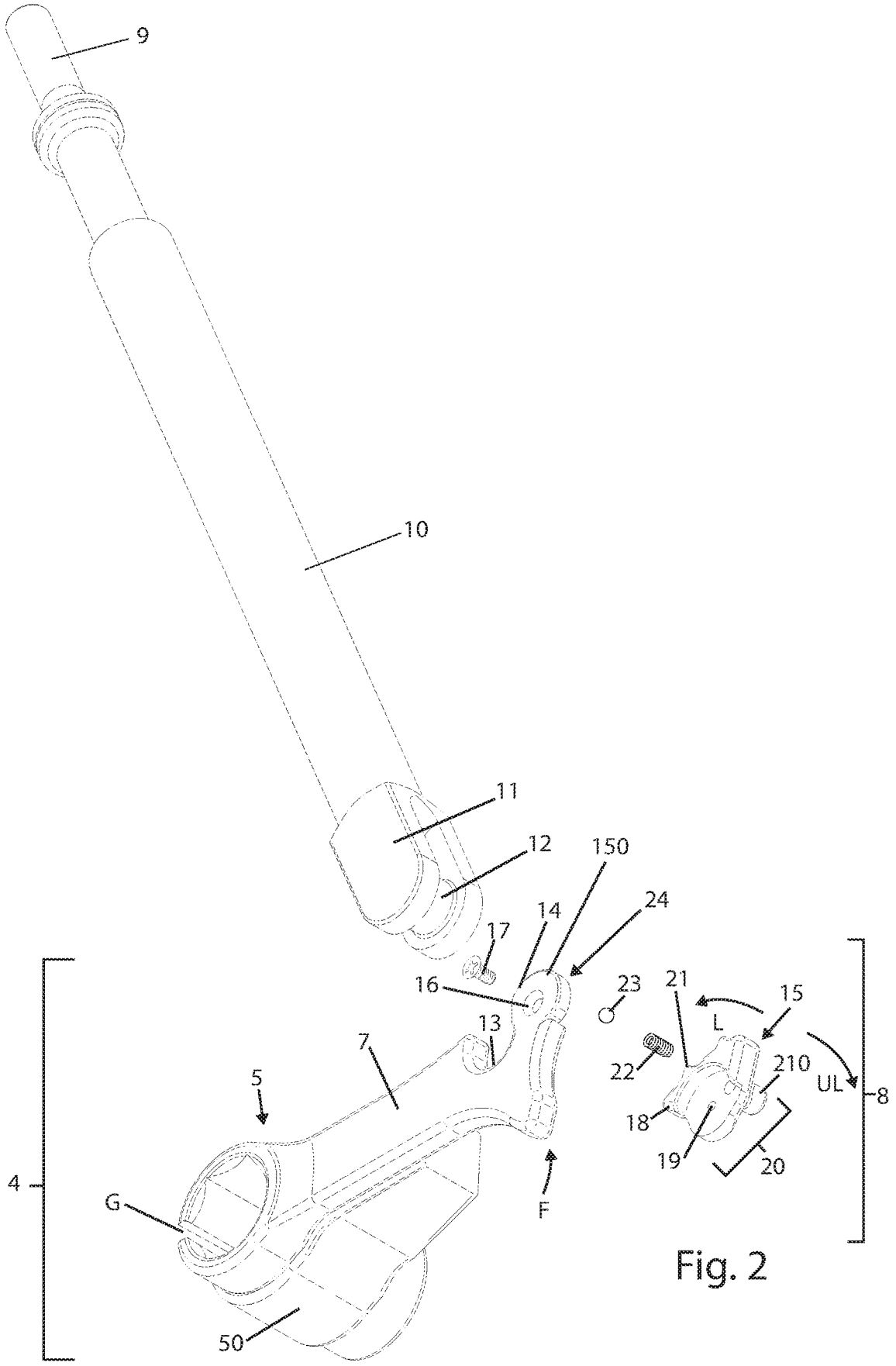
FIG. 2 is an exploded view of the wrench.

Referring next to FIG. 2 the jaw 13 has a distal edge 14. A tooth base 15 extends from distal end (also called the free end) F of wrench 4. Mounting hole 16 receives a bolt 17 that screws into hole 19 of the tooth base 15 of the tooth assembly 20. The tooth assembly 20 is comprised of the locking tooth 18. The mechanic can push on ridge 21 (FIG. 3) to rotate the locking tooth 18 beyond the distal edge 14. In that position the crossbar 12 is locked in jaw 13 by the locking tooth 18. The tooth assembly 20 has a retainer 210 for the spring 22. The spring 22 urges the ball 23 against the outer surface 24 of the pivot end 150. The détente 25 in outer surface 24 of pivot end 150 locks the ball 23 as the spring 22 urges the ball 23 into the détente 25. This mode keeps the crossbar 12 safely locked in jaw 13 as shown by arrow L.

To release the crossbar 12, the mechanic pushes on ridge 21 in direction unlock shown by arrow UL. This mechanical force by the mechanic forces the ball 23 out of détente 25 so the locking tooth 18 clears the distal edge 14.

Figure 3:
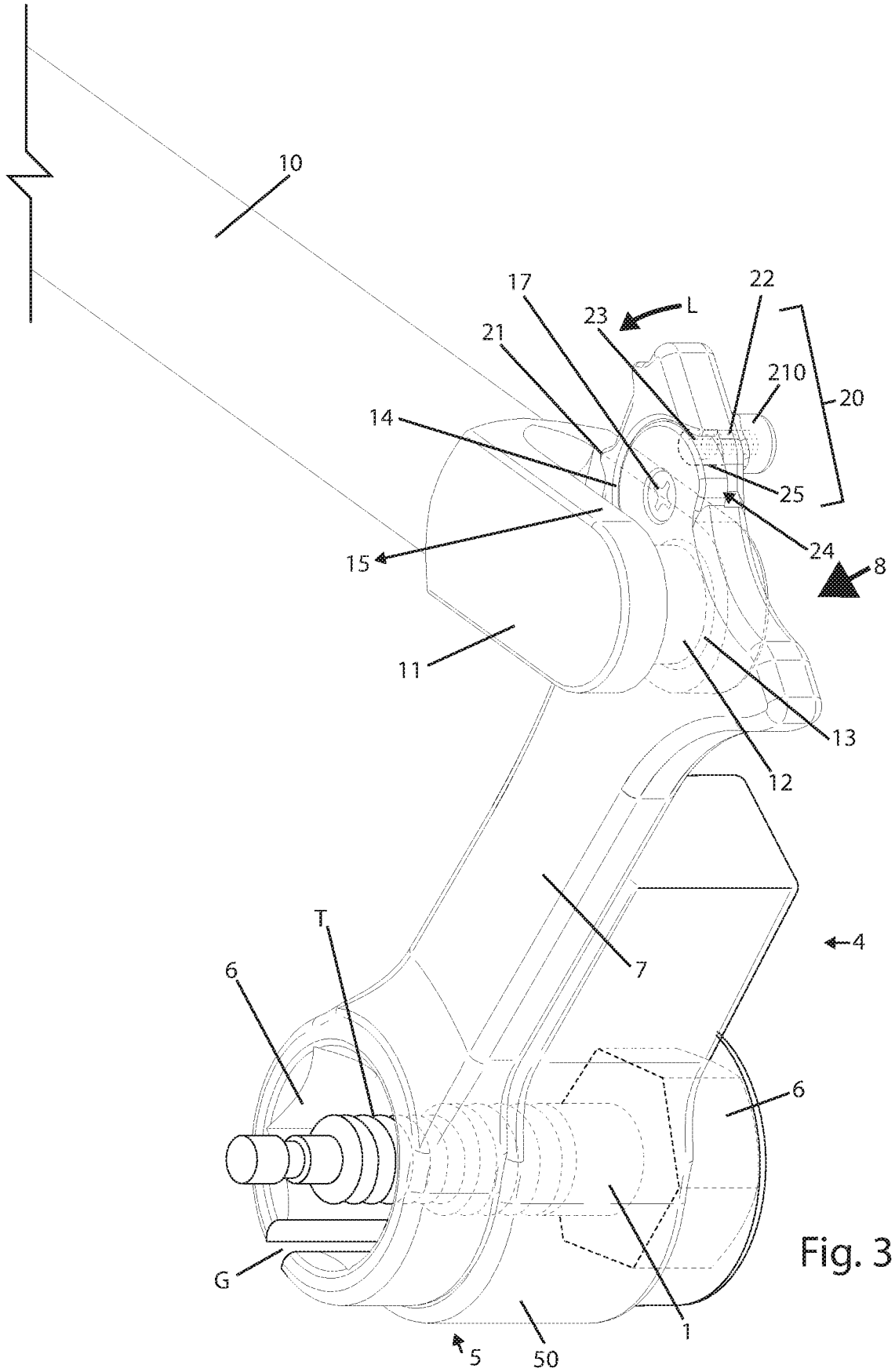
FIG. 3 is a top perspective view of the wrench locked to the air hammer.

In FIG. 3 arrow L shows the tooth assembly 20 in the locked mode. The crossbar 12 is locked in jaw 13 by locking tooth 18. The ball 23 is locked into détente 25 on face 24 of the pivot end 150.

Figure 4:
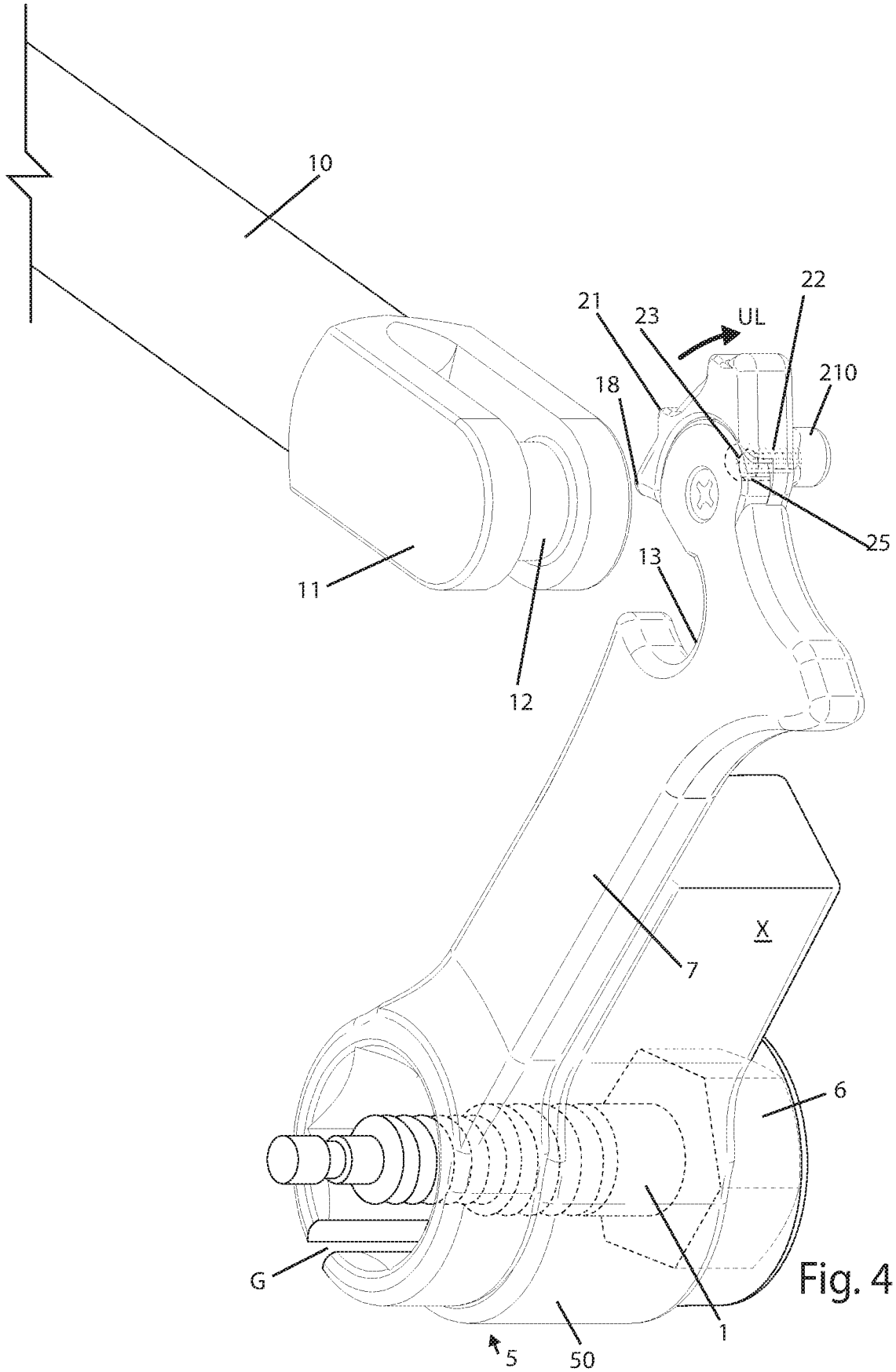
FIG. 4 is a top perspective view of the wrench unlocked from the air hammer.

In FIG. 4 the arrow unlock UL shows that the mechanic has pushed on ridge 21 and released ball 22 from détente 25. Locking tooth 18 is now clear of distal edge 14. Crossbar 12 can be removed from jaw 13. For production of wrench 4 the working component X may be formed with shank 7 or welded to shank 7.

Figure 5:
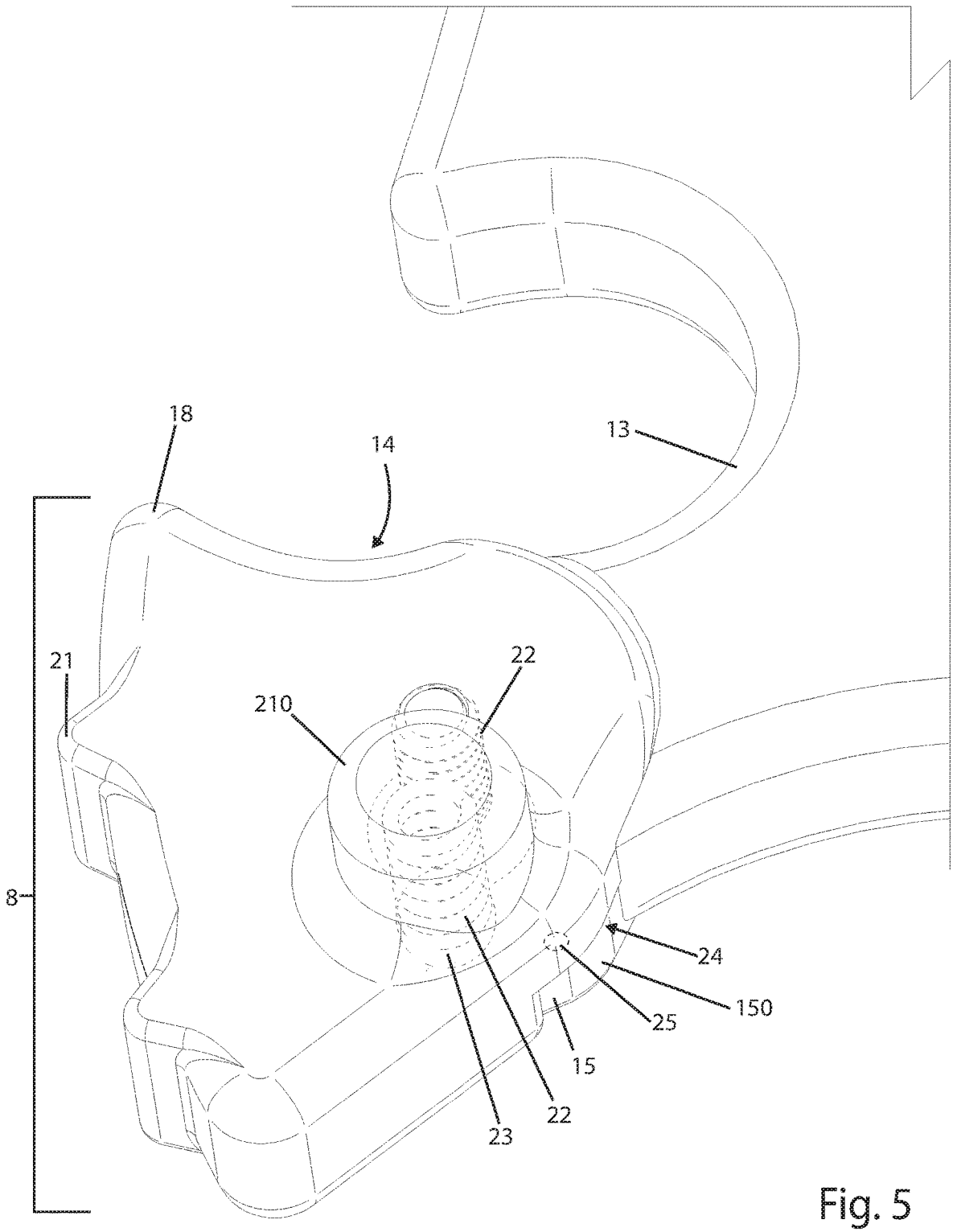
FIG. 5 is a side perspective view of the working face 24 of the tooth base 15.

In FIG. 5 the face 24 of the pivot end 150 is shown. The open mode shows the ball 23 out of the détente 25. The dotted outline of spring 22 shows the motion of the spring 22 when moving from the locked to the unlocked mode.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. An 02 sensor wrench having a working end with a socket to mount a nut of an 02 sensor, a shank connecting the working end to a free end, the free end comprising:

a jaw having a curvature to accept a crossbar of a drive shaft of an air hammer; a pivot end extending beyond the jaw away from the free end;

a tooth assembly pivotably connected to the pivot end by an axle that allows the tooth assembly to rotate from a closed to an open mode;

said tooth assembly having a locking tooth that can rotate beyond an open mouth end of the jaw away from the free end to lock the crossbar therein;

said tooth assembly having a latch ball and a spring that urges the latch ball into a face of the pivot end;

wherein moving the tooth assembly to the open mode allows the crossbar to be placed in the curvature of the jaw;

and wherein moving the tooth assembly to the closed mode forces the latch ball into a détente on the face of the pivot end, thereby preventing an accidental release of the crossbar from the jaw as the air hammer creates rotational force on the working end.

2. The wrench of claim 1, wherein the axle further comprises a threaded bolt that screws into the tooth assembly through a hole in the pivot end.

3. The wrench of claim 1, wherein the tooth assembly further comprises a receptacle that secures the spring.

4. The wrench of claim 1, wherein the crossbar further comprises a pair of parallel arms that support it, said pair of parallel arms connected to the drive shaft of the air hammer that is removably connectable to the air hammer.

5. The wrench of claim 1, wherein the tooth assembly further comprises a finger ridge adjacent the locking tooth.

6. A wrench having a free end with a jaw assembly, said wrench comprising:

a working end having an $O_2$ sensor socket with a shank connected to the free end with the jaw assembly;

said jaw assembly comprising a pivot end extending from the shank beyond a jaw having a curvature to accept a crossbar;

said jaw assembly having a pivotable base that has a locking tooth;

said locking tooth locks around the crossbar in a locked mode and is manually movable to an open mode;

and wherein the locked mode further comprises a détente in the pivot end that receives a spring loaded ball that is mounted in the pivotable base.

7. The wrench of claim 6, wherein the pivotable base further comprises a receptacle to secure the spring and having a finger ridge to facilitate a pivoting of the pivotable base from the open to the locked mode.

8. An air hammer and wrench combination, the combination comprising:

an air hammer with a drive shaft;

a connector at a distal end of the drive shaft, said connector comprising a pair of parallel arms with a transverse crossbar;

a wrench having a working end and a shank connected to a free end, wherein said working end comprises an $O_2$ sensor socket;

said free end having an open jaw sized to accept the crossbar;

said free end having a pivot base extending from a distal edge of the open jaw away from the working end;

a rotating platform pivotally mounted on the pivot base;

said rotating platform having a locking tooth extending from a rotating platform edge adjacent the distal end of the open jaw;

wherein rotating the locking tooth inward in the open jaw locks the crossbar therein;

wherein rotating the tooth outward away from the jaw releases the crossbar from the open jaw;

and wherein a latch secures the locking tooth in the locked position.

9. The combination of claim 8, wherein the latch further comprises a détente on a face of the pivot base and a spring loaded ball on the rotating platform that latches into the détente in the locked position.

10. The combination of claim 9, wherein the rotating platform further comprises a finger ridge to facilitate the rotating.

* * * * *